US005195278A

United States Patent [19]

Grove

[11] Patent Number: 5,195,278

[45] Date of Patent: Mar. 23, 1993

[54] ABRADING TOOL

[76] Inventor: Donald E. Grove, 7200 Galgate Dr., Springfield, Va. 22153

[21] Appl. No.: 757,934

[22] Filed: Sep. 12, 1991

Related U.S. Application Data

[63] Continuation-in-part of Ser. No. 437,380, Nov. 16, 1989.

[51] Int. Cl.[5] ..... B24D 15/00

[52] U.S. Cl. ..... 51/392; 51/205 R

[58] Field of Search ..... 51/391-393, 51/400, 404, 358, 205 R; 401/68; 132/320; 15/209 D

[56] References Cited

U.S. PATENT DOCUMENTS 1,024,126 4/1912 Fletcher ..... 51/205 R

*Primary Examiner*—Douglas D. Watts

*Attorney, Agent, or Firm*—Abdallah & Muckelroy

[57] ABSTRACT

A manually-controllable tool for abrading close spaces when preparing a surface for receipt of varnishes, paint and the like. In one embodiment of the abrading tool abrasive materials of different coarseness grades are fixedly attached to the respective ends of a stick handle. In another embodiment of the abrading tool abrasive material is selectively fed through a mechanical pencil device.

2 Claims, 3 Drawing Sheets

ABRADING TOOL

This application continuation-in-part of Ser. No. 437,380, filed Nov. 16, 1989 and entitled "Abrading Tool", now abandoned. The disclosure of the parent application, Ser. No. 437,380, filed Nov. 16, 1989 is incorporated by reference.

BACKGROUND OF THE INVENTION

The present invention generally relates to abrading tools for buffing, cleaning and polishing of surfaces. More specifically, the present invention relates to abrading tools for buffing, cleaning and polishing tight spaces in intricate carvings, artwork and the like.

Abrasive materials, for example steel wool, are generally known in the prior art for their utility in preparing surfaces for receipt of finishes such as paint, oil, varnish and the like. Recessed and raised areas of a surface cannot be easily prepared by the means presently known in the prior art because of the close spaces formed thereby. There is therefore a pressing need for a means to abrade the narrow spaces formed by intricate carvings and markings.

In U.S. Pat. No. 4,154,026 to Paithe an abrading tool providing support for a coiled strip of abrasive material is disclosed for use with a power tool such as a lathe, drill or routing machine. The abrading tool of the Paithe invention is limited to use with strips of abrasive material and power tools. This limitation does not permit the manual control of the abrasive material necessary for many artistic works and the flexibility of using different types and grades of abrasive materials. In U.S. Pat. No. 4,793,828 to Burnand there is disclosed an abrading tool having a working portion including an abrasive insert suitable for use in high temperatures. This abrasive tool is likewise directed toward use with a dressing or turning tool, or power drill, and discloses improvements in the resistance to high temperature deterioration.

SUMMARY OF THE INVENTION

The abrading tool of the present invention provides a simple and manually-controllable means for buffing, cleaning or polishing close spaces with abrasive materials. In one embodiment of the present invention abrasive material of a first grade is fixedly attached to an end of a rigid stick handle and abrasive material of a second grade is fixedly attached to the opposite end of the stick handle. In another embodiment of the abrading tool of the present invention abrasive material is selectively feed through a mechanical pencil device which can receive abrasive material of various grades.

An object of the present invention is to provide an abrading tool for close spaces.

Another object of the present invention is to provide a reusable tool for buffing, cleaning or polishing surfaces with abrasive material.

A further object of this invention is to provide an abrading tool that can be manually controlled in a manner to permit artistic stroking.

It is also an object of the present invention to provide an abrading tool suitable for preparing intricate raised and recessed shapes and patterns for receipt of finishes such as oil, varnish and the like.

A still further object of the present invention is to provide an abrading tool having two distinct working surfaces in a single tool.

These and other objects and advantages of the present invention will be apparent to those skilled in the art from the following description of preferred embodiments, claims and accompanying drawings.

DESCRIPTION OF PREFERRED EMBODIMENTS

Figure 2:
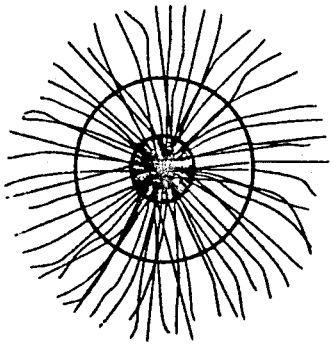
FIG. 2 is an end cross-sectional view taken along line 2—2 of FIG. 1.
Figure 1:
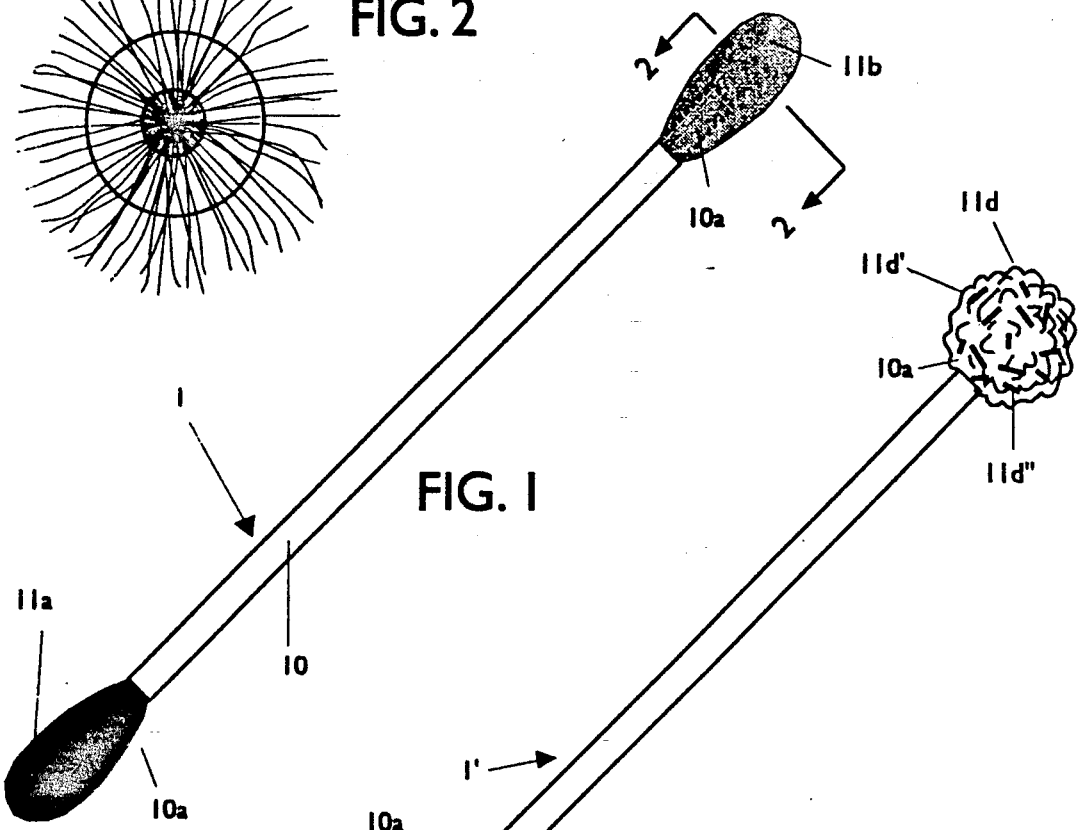
FIG. 1 is a side perspective view of a first preferred embodiment of the present invention.

FIG. 1 illustrates in a side perspective view a first preferred embodiment of an abrading tool 1 in accordance with the present invention. First abrading tool 1 comprising a rigid stick handle 10 having first and second abrading tips 11*a* and 11*b* fixedly attached at respective ends 10*a* of said stick handle 10. Stick handle 10 is preferably formed of wood material having a round cross section to facilitate manual control of first abrading tool 1. Abrading tips 11*a*, 11*b* are respectively formed from a wad of abrasive fibers, for example, steel wool fibers. Each abrading tip 11*a* and 11*b* is formed from fibers having a different coarseness as designated by ASTM (American Society for Testing and Materials). For example, coarse grade steel wool fibers may be attached one end of the stick handle 10, and fine grade steel wool fibers may be attached at the opposite end of the stick handle 10. Thereby different working surfaces are made available in a single abrading tool 1. The wad of fibers forming the abrading tips 11*a*, 11*b* may be glued to the end of said stick handle 10. Alternatively, as best seen in the end cross-sectional view of the abrading tool 1 shown in FIG. 2, the abrading tool 1 includes a slot 12 formed in the ends of said stick handle 10 and the abrasive fibers forming the tips 11*a* and 11*b* may be attached to the end of stick handle 10 by stuffing a thin portion of the wad of abrasive fibers into the slot 12 and winding the remaining portions of the tips 11*a*, 11*b* around the outside portion of the stick handle 10. By so attaching the abrasive fibers to the stick handle 10 a cushion can be built up of varying size which helps to prevent the stick handle 10 from pushing through the tips 11*a*, 11*b*.

Figure 3:
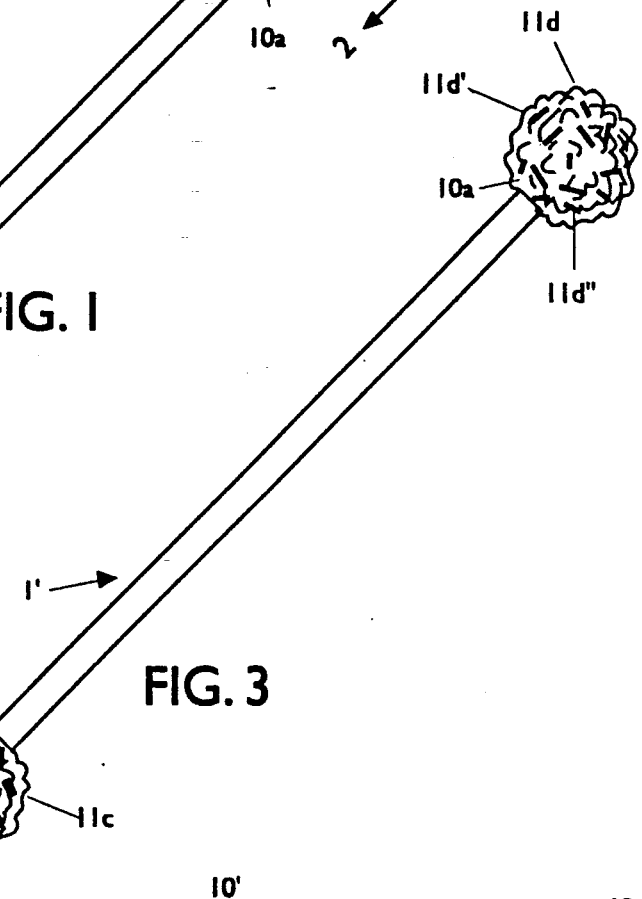
FIG. 3 is a side perspective view of a second preferred embodiment of the present invention.

A second preferred abrading tool 1' constructed substantially as shown and described for first abrading tool 1 is illustrated in FIG. 3. Second abrading tool 1' comprises a stick handle 10 having respective third and fourth abrading tips 11*c* and 11*d* fixedly attached to respective ends 10*a* of stick handle 10. Third abrading tip 11*c* and fourth abrading tip 11*d* respectively comprise a wad of cotton 11*c'*, 11*d'* impregnated with fibrous abrasive materials 11*c''*, 11*d''*, for example a plurality of short slivers of metal. The abrasive materials 11*c''*, 11*d''* in third and fourth tips 11*c*, 11*d* provide means to abrade the surface being worked and the cotton wads 11*c'*, 11*d'* provide means to retain moisture in tips 11*c*, 11*d* for wetting of the surface being worked, and/or for collecting and removing from the surface being worked the dust particles resulting from abrading operations. It is preferred that the respective third and fourth abrading tips 11*c*, 11*d* are formed in a manner to provide in a single tool means to abrade a surface to varying degrees of smoothness. This may be accomplished by utilizing abrasive materials 11*c''*, 11*d''* having different abrading characteristics in the respective tips 11*c*, 11*d*, e.g. slivers of metal of different lengths, or slivers of different metal materials.

Figure 4:
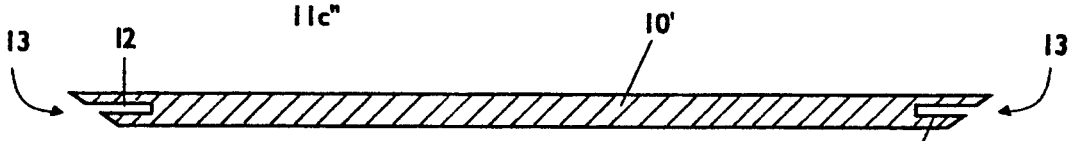
FIG. 4 is a side plan cross-sectional view of a stick handle having beveled ends.
Figure 5:
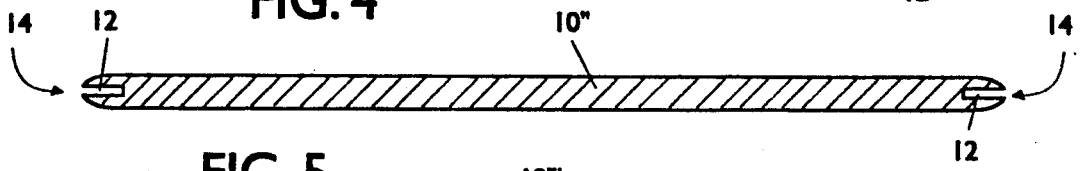
FIG. 5 is a side plan cross-sectional view of a stick handle having rounded ends.
Figure 6:
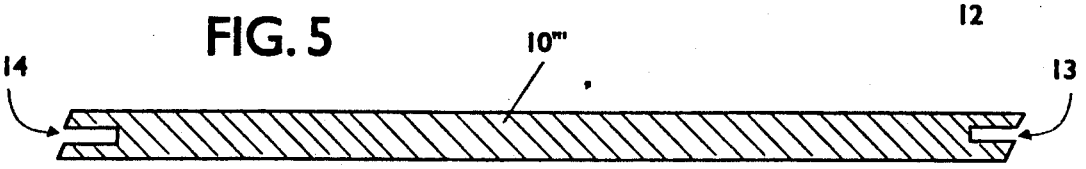
FIG. 6 is a side plan cross-sectional view of a stick handle having a rounded end and a beveled end.

The tips 11*a*, 11*b*, 11*c*, 11*d* of abrading tools 1 and 1' conform to the end of the stick handle 10 when pressed or rubbed against the surface to be abraded. Therefore alternative profiles of the end of stick handle 10 provide additional utility in the abrading tools 1, 1' by permitting the abrasive material of the tips 11*a*, 11*b*, 11*c*, 11*d* to conform to close spaces of varying surface contours. In FIGS. 1 and 3 the stick handle ends 10*a* are shown having a flat profile which is suitable for abrading a flat surface. Alternative stick handle end profiles are illustrated in FIGS. 4–6. FIG. 4 illustrates in a side plan cross-sectional view a stick handle 10' having beveled ends 13; FIG. 5 illustrates in a similar view a stick handle 10'' having convexed ends 14; and FIG. 6 illustrates in a similar view a stick handle 10''' having a beveled end 13 and a convexed end 14. A stick handle 10' having beveled ends 13 is suitable for abrading an angularly recessed surface, for example, and a stick handle 10'' having convexed ends 14 is suitable for abrading a concave surface contour. A stick handle 10''' formed with a beveled end 13 at one end and a convexed end 14 at the opposite end, or various combinations of flat end 10*a*, beveled end 13 or convexed end 14, provides a single tool that can be utilized for abrading a variety of surface contours. First and second abrading tools 1 and 1' provide a simple device for artistic control of abrasive material. Utilizing the teachings of this disclosure a variety of abrading tools 1 can be constructed which meet the various needs of a user seeking to buff, clean or polish a surface having intricate carvings or markings.

Figures 7, 8:
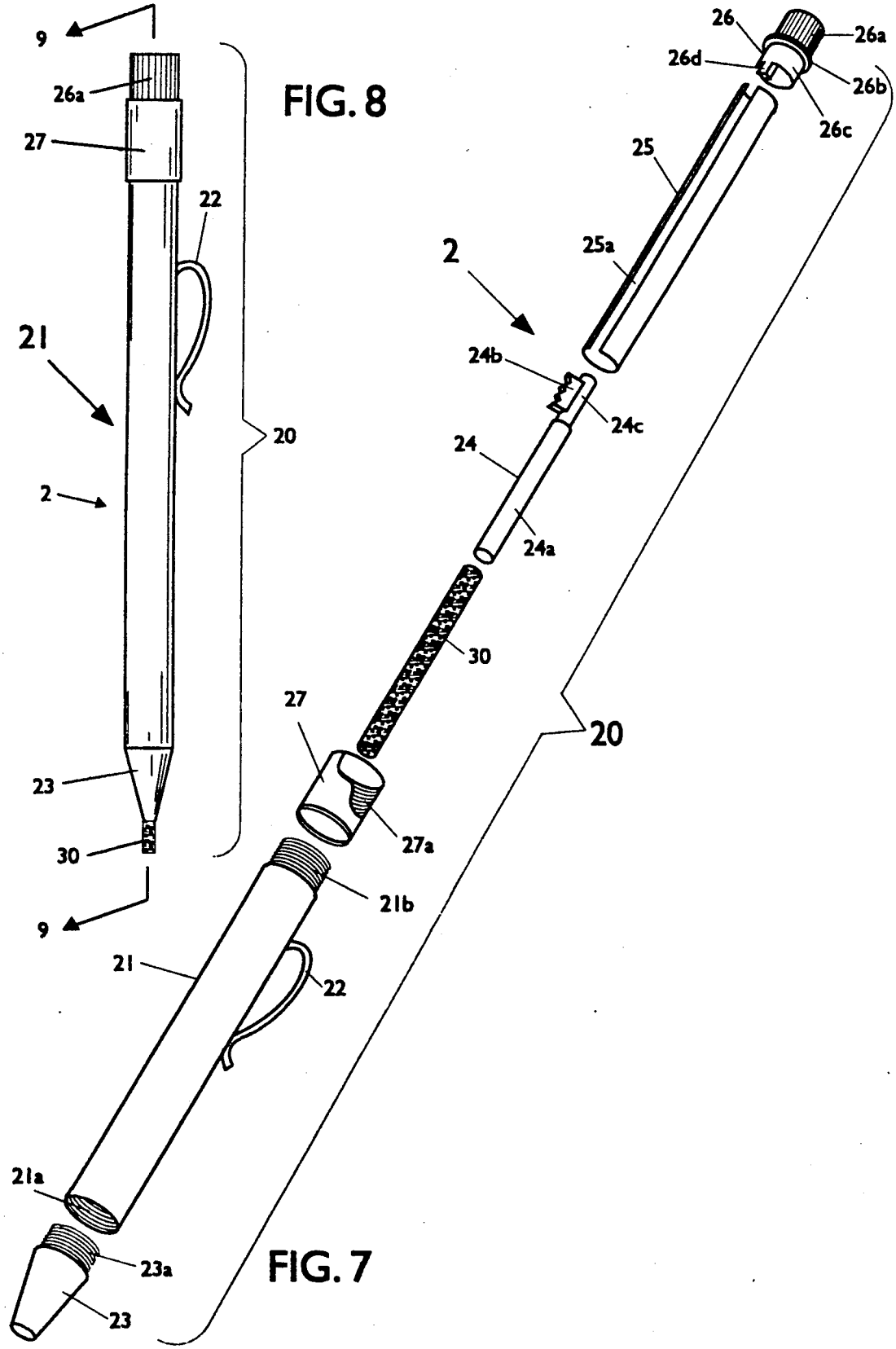
FIG. 7 is an exploded perspective view of a third preferred embodiment of the present invention.
FIG. 8 is a perspective view of an assembled third preferred embodiment of the present invention.

FIGS. 7–10 illustrate a third preferred embodiment of an abrading tool 2 constructed in accordance with the teachings of the present invention. Third abrading tool 2 comprises a mechanical pencil device 20 which receives a thin rope core 30 of abrasive material, said rope core 30 being preferably formed from steel wool. The core 30 of abrasive material can be replaced when worn and thus third abrading tool 2 provides a manually controllable and perpetually reusable pencil device 20 for buffing, cleaning or polishing in close spaces. FIG. 7 illustrates in an exploded perspective view the components of the mechanical pencil device 20 and their interrelationship with each other and the rope core 30 of abrasive material. Mechanical pencil device 20 generally includes a tubular outer barrel 21 having a pocket clip 22 fixedly disposed on the outer wall of said outer barrel 21; a pencil tip 23 threadedly attachable to the lower end of said outer barrel 21; a worm gear 24, worm gear barrel 25, and feed knob 26 disposable within said outer barrel 21 as hereinafter described in greater detail; and a feed knob retaining cap 27 threadedly attachable to the upper end of said outer barrel 21 about said feed knob 26. FIG. 8 illustrates an assembled third abrading tool 2.

Figure 9:
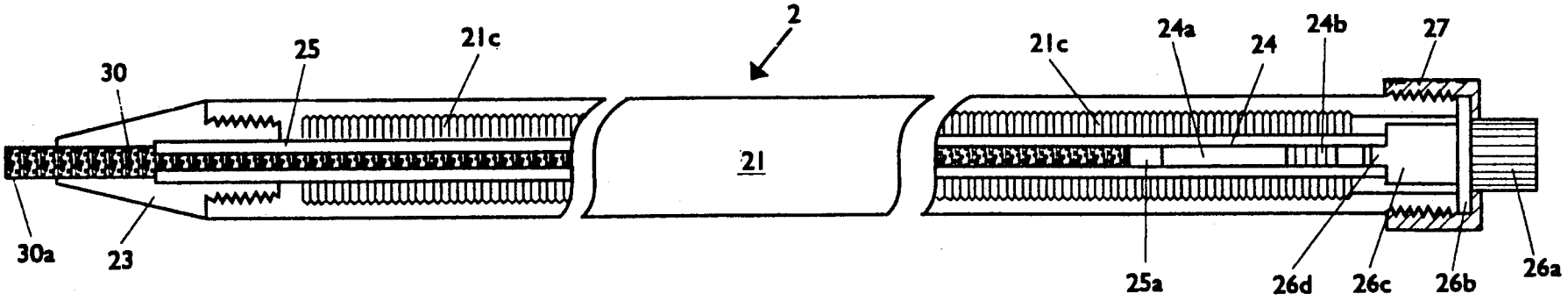
FIG. 9 is a partially fragmented cross-sectional view of the third preferred embodiment taken along line 9—9 of FIG. 8.
Figure 10:
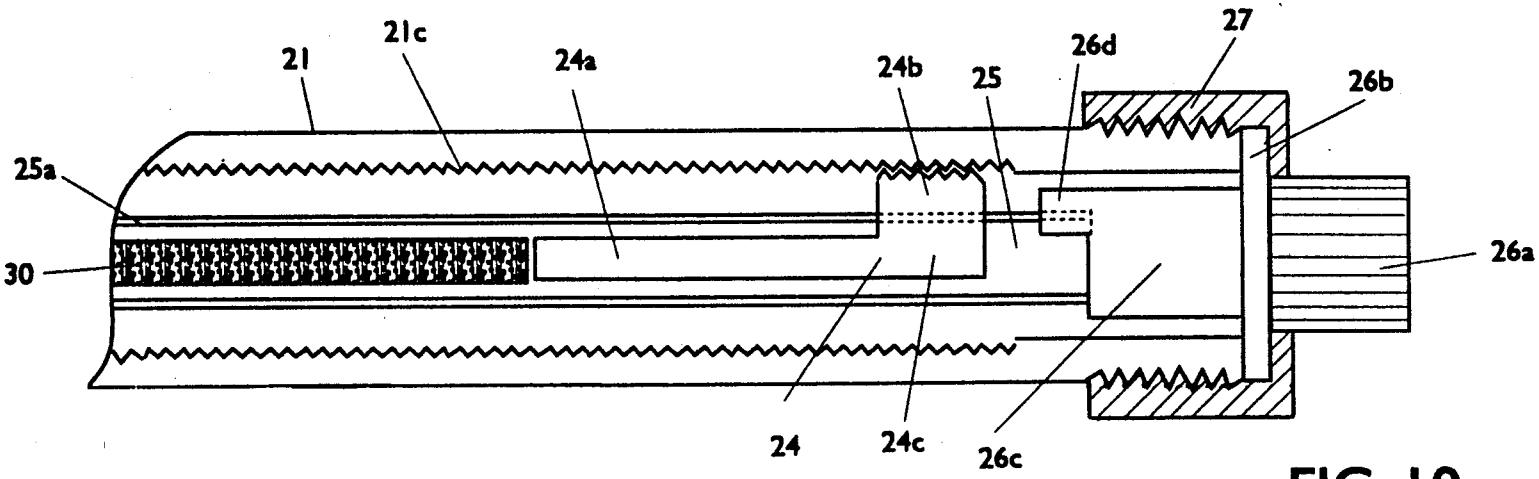
FIG. 10 is an enlarged cross-sectional view of the top end of the third preferred embodiment taken at 90° from the view shown in FIG. 9.

Referring again to FIG. 7 it can be seen that the outer barrel 21 includes threads 21*a* formed on the inner wall of said barrel 21 at its lower end for threadedly engagement with complimentarily formed threads 23*a* disposed on the upper end of pencil tip 23. Outer barrel 21 is preferably formed from metal or dense plastic material and pencil tip 23 is preferably formed from nylon or other material that will resist the wear to be encountered from frictional contact with the abrasive material of the rope core 30. Outer barrel 21 further includes threads 21*b* formed on the outer wall of said barrel 21 at its upper end for threadedly engagement with complimentarily formed threads 27*a* formed on the inner wall of said feed knob retaining cap 27 as hereinafter described in greater detail and shown in FIGS. 9 and 10. Worm gear barrel 25 is substantially a tubular member, preferably formed from a metal material, having a slot 25*a* formed therein that extends for the length of said worm gear barrel 25. When the pencil device 20 is assembled, the worm gear 24 and rope core 30 are slidably disposed within said worm gear barrel 25 and feed knob 26 engages the upper end of said worm gear barrel 25. Worm gear 24 is preferably formed from a plastic material and includes a worm gear body 24*a* and an integrally formed worm gear head 24*c*, the worm gear body 24*a* being disposed toward the lower end of said worm gear barrel 25. Worm gear teeth 24*b* are formed to one side of said worm gear head 24*c* in a manner to extend beyond the worm gear barrel 25 when disposed therein, said worm gear teeth 25*b* fitting within the slot 25*a* of said worm gear barrel 25 and being held in place by the sides of said slot 25*a*. The worm gear teeth 24*b* are threadedly engageable with worm gear engagement threads 21*c* formed on the inner walls of said outer barrel 21 at substantially the mid-section of said outer barrel 21 (FIG. 10). The feed knob 26 includes a feed knob grip 26*a*, a feed knob worm gear barrel connector 26*c*, and a feed knob ridge 26*b* integrally formed between said feed knob grip 26*a* and said connector 26*c*. Vertical serrations are formed in said feed knob grip 26*a* to facilitate manual grasping of said feed knob 26 with the fingers of the user, and feed knob worm gear barrel connector 26*c* includes a connector extension 26*d* integrally formed at the free edge of said connector 26*c*, said extension 26*d* being formed to slip fit within the slot 25*a* of said worm gear barrel 25. The mechanical pencil device 20 as shown in FIG. 8 is assembled by threadedly engaging said pencil tip 23 with the lower end of said outer barrel 21, slidably mounting said worm gear 24 and rope core 30 within the worm gear barrel 25 with the teeth 24*b* of said worm gear 24 disposed within the slot 25*a* of said barrel 25, attaching said feed knob 26 to the upper end of said worm gear barrel 25 with the feed knob connector extension 26*d* disposed within the slot 25*a* of said worm gear barrel 25, disposing said core 30, worm gear 24, and worm gear barrel 25 within the body of said outer barrel 21, and threadedly engaging said feed knob retaining cap 27 with the threads 21*b* formed at the upper end of said outer barrel 21 with the ridge 26*b* of said feed knob 26 disposed below the upper end of said feed knob retaining cap 27 (FIG. 9). Various cores 30 of different grades of coarseness may be utilized in the mechanical pencil device 20 of the present invention.

For operation of the mechanical pencil device 20 of the present invention reference is now made to the cross-sectional views shown in FIGS. 9 and 10. The rope core 30 of abrasive material is selectively feed through the mechanical pencil device 20 by rotation of the feed knob grip 26*a* with the fingers of the user. The rotation of the feed knob grip 26*a* causes the feed knob connector 26*c* to rotate in the same direction. The engagement of the connector extension 26*d* within the slot 25*a* of said worm gear barrel 25 thereby causes the barrel 25 to likewise rotate. The teeth 24*b* of said worm gear 24 in turn engage the threads 21*c* formed in the inner wall of said outer barrel 21 and since the worm gear 24 is slidably mounted within said worm gear barrel 25 with the teeth 24*b* fixedly disposed within the slot 25*a* of said worm gear barrel 25, the rotation of the feed knob grip 26 causes the worm gear to move in slidable engagement downwardly within said worm gear barrel 25. The downward movement of the worm gear 24 within said worm gear barrel 25 causes the worm gear body 24*a* to push against the rope core 30 thereby feeding the rope core 30 of abrasive material through the tip 23 of said pencil device 20. The protruding end 30*a* of said rope core 30 may be selectively brushed back and forth to flare the end 30*a* for varying abrading contours.

While various embodiments of the present invention have been described, such descriptions are intended to be illustrative and not a limitation on the present disclosure as claimed below. Various changes, modifications and additions may be made without departing from the spirit and scope of this invention. Such changes, modifications and additions within a fair reading of the appended claims are intended as part of the present disclosure.

Therefore in view of the foregoing, I claim:

1. An abrading tool for close spaces comprising manually-controllable abrasive material support means consisting of a mechanical pencil device, and a rope core of abrasive material selectively removable and replaceable in said mechanical pencil device, said mechanical pencil device comprising an outer barrel having first threads formed in an inner wall of said barrel at its lower end, second threads formed in an outer wall of said barrel at its upper end, and third threads formed in the inner wall of said barrel at its mid-section;

a pencil tip threadedly attachable to said first threads of said outer barrel; and an abrasive material feed assembly disposed within said mechanical pencil device and threadedly attachable to said second threads of said outer barrel, said rope core of abrasive material being selectively engageable within said feed assembly in a manner to be selectively fed through said pencil tip.

2. An abrading tool as described in claim 1 wherein said abrasive material feed assembly comprises a worm gear, a worm gear barrel having a slot formed therein extending for the length of said worm gear barrel, and a feed knob;

said worm gear comprising a worm gear body integrally formed with a worm gear head, said worm gear being slidably mounted within said worm gear barrel, said worm gear head having a plurality of teeth formed to one side of said worm gear head, said teeth being disposed within the slot of said worm gear barrel beyond the outer surface of said worm gear barrel, said teeth being engageable with said third threads of said outer barrel;

said feed knob comprising integrally constructed feed knob grip, feed knob ridge and feed knob worm gear barrel connector means, said ridge being disposed between said grip and said connector means, said connector means including an extension attachable within the slot of said worm gear barrel at the upper end of said worm gear barrel; and a feed knob retaining cap, said cap being threadedly attachable to said second threads of said outer barrel having the upper end of said cap disposed about the ridge of said feed knob;

said rope core of abrasive material being selectively engageable within said worm gear barrel adjacent to the body of said worm gear.

* * * * *